US005667090A

United States Patent [19]

Langham, Jr. et al.

[11] Patent Number: 5,667,090

[45] Date of Patent: Sep. 16, 1997

[54] RETURNABLE SHIPPING CONTAINER

[75] Inventors: Robert Fred Langham, Jr.; William Techlin, both of Beavercreek; Robert Anthony Soehner, Vandalia; Gary Lee Harakay, Union, all of Ohio

[73] Assignee: General Motors Corporation, Detroit, Mich.

[21] Appl. No.: 556,293

[22] Filed: Oct. 6, 1995

[51] Int. Cl.[6] ..... B65D 6/20

[52] U.S. Cl. ..... 220/6; 220/7; 220/62; 220/4.29

[58] Field of Search ..... 229/125.22, 67; 206/499, 524.9, 445, 335, 757, 758, 774; 220/6, 7, 62, 529, 554, 666, 4.29, 4.28

[56] References Cited

U.S. PATENT DOCUMENTS

| | | | |
|---|---|---|---|
| 1,676,298 | 7/1928 | Stieglitz | 220/62 |
| 2,459,921 | 1/1949 | Comer | 220/62 |
| 3,219,179 | 11/1965 | Tuccio | 220/62 |
| 3,904,105 | 9/1975 | Booth | 229/125.22 |
| 3,954,219 | 5/1976 | Mangini et al. | 229/125.22 |
| 3,981,395 | 9/1976 | Dalgleish | 206/0.82 |
| 4,541,528 | 9/1985 | Holmes | 206/0.82 |
| 4,715,492 | 12/1987 | Holmes | 206/0.83 |
| 5,012,971 | 5/1991 | Cozzi et al. | 220/529 |
| 5,226,557 | 7/1993 | Nelson | 220/461 |
| 5,284,246 | 2/1994 | Chamberlin et al. | 206/394 |
| 5,320,065 | 6/1994 | Leopold | 220/4.29 |
| 5,324,105 | 6/1994 | Christensen | 312/319.4 |

FOREIGN PATENT DOCUMENTS

| | | | |
|---|---|---|---|
| 445169 | 11/1912 | France | 229/125.22 |

*Primary Examiner*—Stephen J. Castellano
*Attorney, Agent, or Firm*—Charles E. Leahy

[57] ABSTRACT a returnable shipping container for manufactured articles, such as vehicle steering wheels, which is comprised of a plurality of rectangular wall panels which are serially arranged side-by-side and have a hinge interposed between each adjacent panel with the end most of the panels each having a free side thereof. A separable fastener device establishes the free sides of the endmost panels in adjacent relationship to form a container of a tubular configuration defining an interior storage cavity. Separating the fastener allows the container to be opened and laid flat. A plurality of slots are provided in spaced apart relation along at least two of the wall panels and a plurality of shelf members are provided having a base wall adapted to lay against the slotted wall panels and having shelf arms which project through the slots and into the storage cavity to engage with and support the articles stored therein.

5 Claims, 2 Drawing Sheets

RETURNABLE SHIPPING CONTAINER

The invention relates to a returnable shipping container for manufactured articles.

BACKGROUND OF THE INVENTION

It is well known in the manufacturing industry to ship manufactured articles in bulk from a manufacturing location to an assembly plant. It is desirable to ship these manufactured articles in containers which securely nest and protect the manufactured articles during shipment. It is also desirable that the containers be readily opened and closed to facilitate the loading and unloading of the manufactured articles In addition, it is desirable that the shipping containers collapse or unfold to a configuration which occupies a minimal volume for return of the shipping containers to the point of origin for reuse.

SUMMARY OF THE INVENTION

The present invention provides a returnable shipping container for manufactured articles, such as vehicle steering wheels, which is comprised of a plurality of rectangular wall panels which are serially arranged side-by-side and have a hinge interposed between each adjacent panel with the end most of the panels each having a free side thereof. A separable fastener device establishes the free sides of the endmost panels in adjacent relationship to form a container of a tubular configuration defining an interior storage cavity. Separating the fastener allows the container to be opened and laid flat. A plurality of slots are provided in spaced apart relation along at least two of the wall panels and a plurality of shelf members are provided having a base wall adapted to lay against the slotted wall panels and having shelf arms which project through the slots and into the storage cavity to engage with and support the articles stored therein.

The wall panel is preferably a continuous formed strip of material, such as corrugated plastic, which is scored to provide integral living hinges to define the plurality of wall panels.

DESCRIPTION OF THE PREFERRED EMBODIMENT

Figure 1:
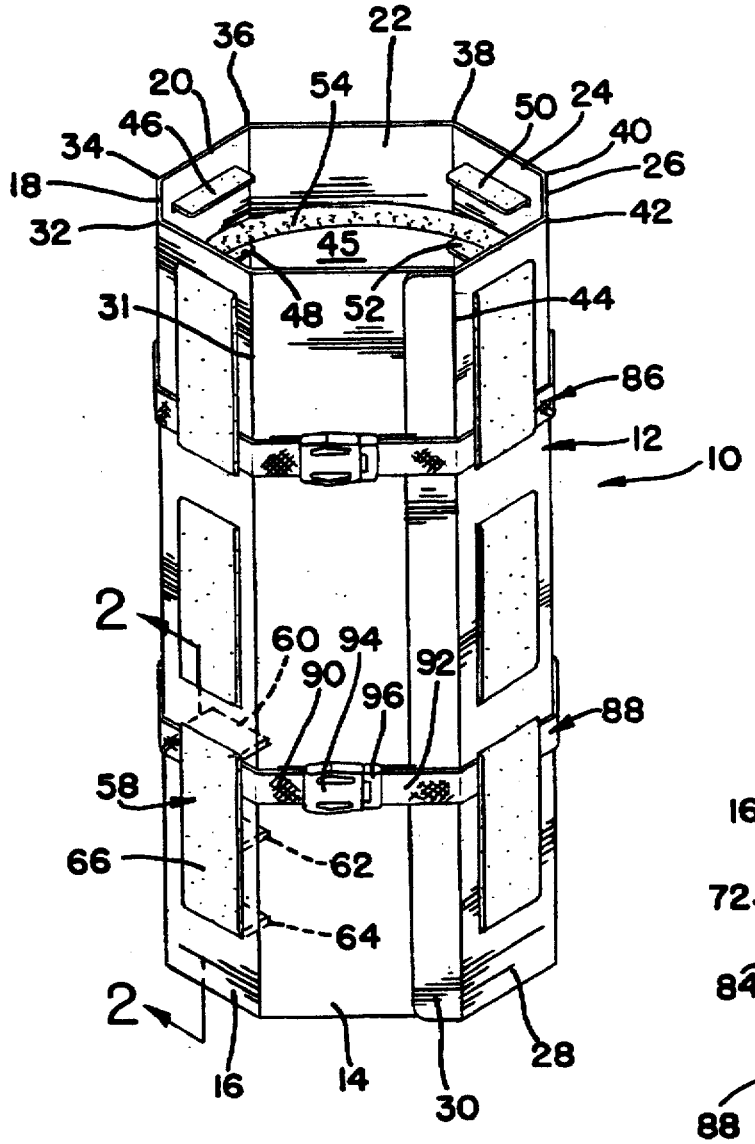
FIG. 1 is a perspective view of the shipping container 10 shown in the closed position for shipping vehicle steering wheels.
Figure 2:
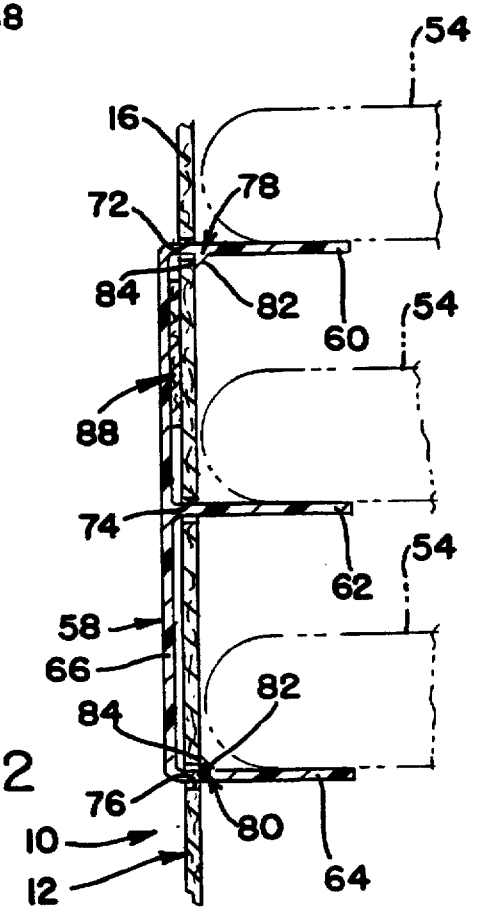
FIG. 2 is a section view taken in the view of arrow 2—2 of FIG. 1.

Referring to FIGS. 1 and 2, a returnable shipping container 10 is comprised of a sheet of corrugated plastic material 12 which is transversely scored periodically along its length to define a plurality of rectangular wall panels 14, 16, 18, 20, 22, 24, 26 and 28, and an end flap 30. The scoring of the corrugated panel 12 provides living hinges at 31, 32, 34, 36, 38, 40, 42 and 44 so that the corrugated sheet 12 can be readily bent into the tubular configuration of FIG. 1, thereby defining an interior storage cavity 45.

FIG. 1 shows shelf arms 45, 48, 50 and 52 which project into the interior storage cavity 45 to capture and support a steering wheel 54. It will be understood that additional shelf arms are arranged vertically along the height of the shipping container 10 to effectively support a plurality of such steering wheels for shipment from a manufacturing plant to a vehicle assembly plant.

Referring to FIG. 2, it is seen that a typical shelf assembly 58 includes arms 60, 62 and 64 project inwardly from the side wall 16 of the shipping container. These shelf arms are formed integrally and connected together by a base wall 66. The shelf assembly 58 is preferably manufactured as a plastic extrusion which is then sliced transversely to provide the shelf assembly 58. The wall panel 16 has die cut slots 72, 74 and 76 therein through which the shelf arms 60, 62 and 64 are inserted. The shelf arm 60 and shelf arm 64 respectively have integral locking shoulders 78 and 80 extruded therewith which pass through the slot and have a ramped face 82 which passes readily through the slot and a normal extending locking face 84 which engages against the wall panel 16 to lock the shelf assembly 58 in place.

As seen in FIG. 1, a plurality of shelf assemblies, identical to the shelf assembly 58, are likewise installed through slots provided in the side walls to provide shelf arms which are spaced regularly along the interior of the shipping container.

Referring to FIG. 1, it is seen that the sheet of corrugated material 12 is retained in the tubular configuration of FIG. 1 by a pair of fastening straps 86 and 88. The straps are a flexible fabric material, such as nylon, and encircle the tubular configuration. As seen in FIG. 2, the strap 88 passes between the base wall 66 of the shelf assembly 58 and the wall panel 16 so that the shelf assembly functions to locate and retain the position of the fastening strap 88. The fastening strap 88 has ends 90 and 92 which respectively carry a mating separable plastic buckle elements 94 and 96. The separable buckle elements 94 and 96 can be any commercially available belt fastening hardware, preferably of low cost, light weight plastic construction. The end flap 26 of the corrugated sheet 12 overlies the end most wall member 14 to provide improved closure and connection between the end most panel walls 14 and 28.

Figure 3:
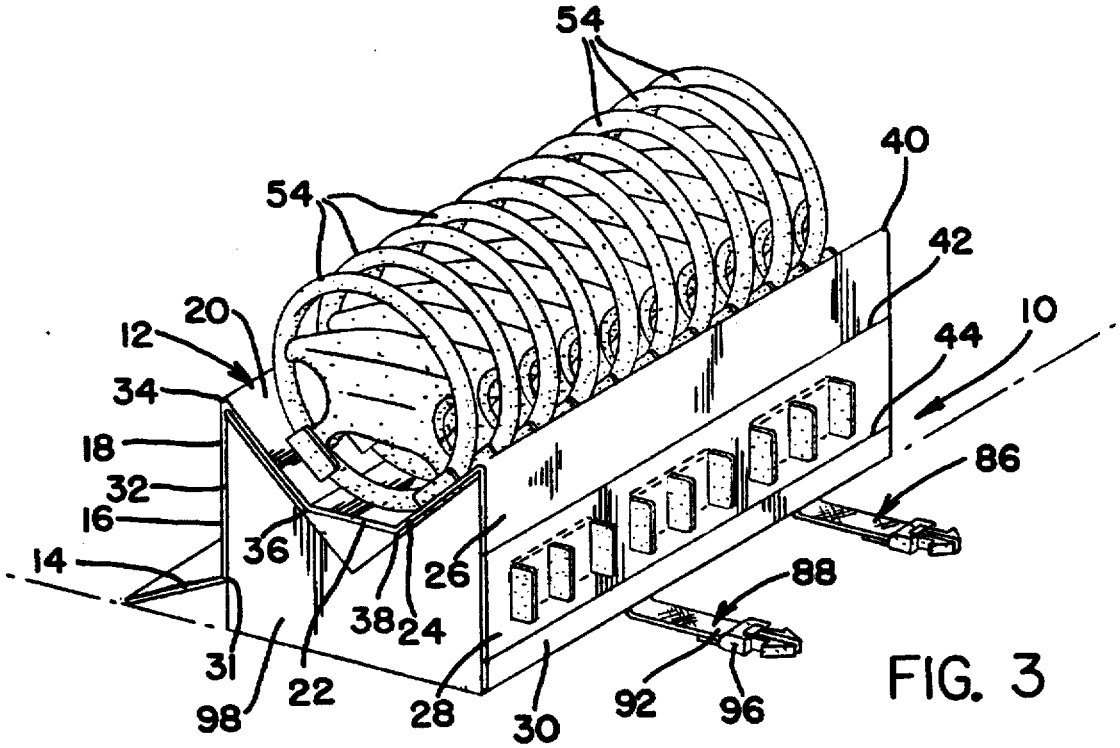
FIG. 3 is a perspective view showing the shipping container of FIG. 1 opened to permit unloading of the steering wheels.
Figure 4:
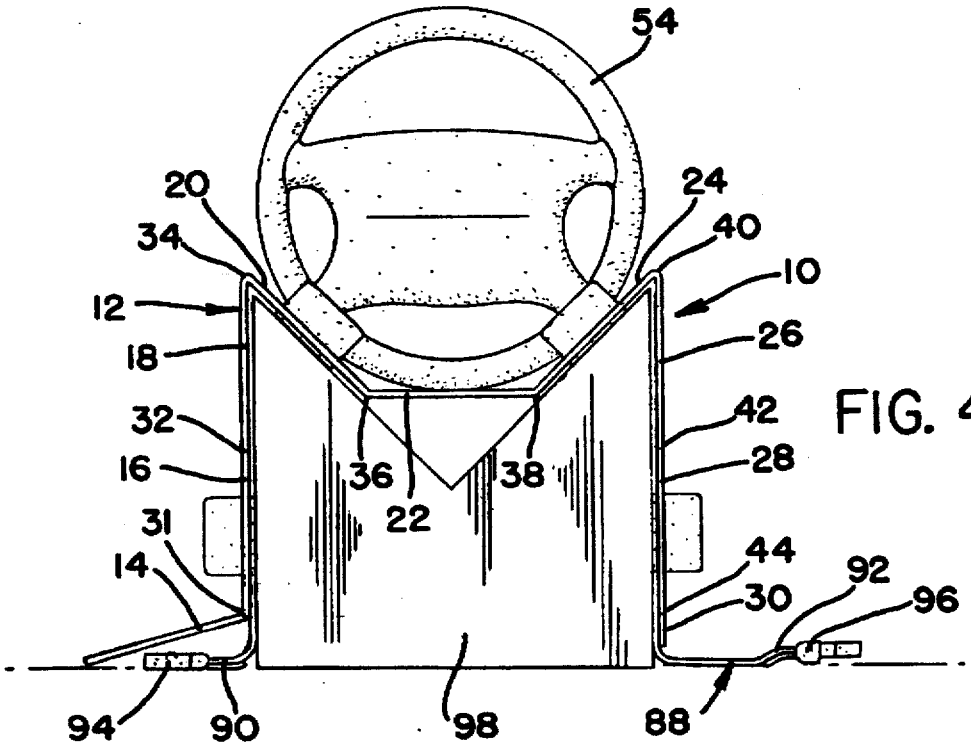
FIG. 4 is an end view of the shipping container of FIG. 3.

As seen in FIG. 3, steering wheels 54 can be readily loaded and unloaded from the container by draping the container 10 over a supporting fixture 98. In particular, the shipping container 10 of FIG. 1, fully loaded with steering wheels, may be laid atop the support fixture 98, the buckle elements unfastened and then the side walls 14, 16, 18, 26 and 28 unfolded to the position of FIG. 3 allowing ready access to the steering wheels 54.

Referring again to FIG. 1, it is seen in the preferred embodiment that the shipping container 10 is octagonal in shape and has the shelf members provided on alternating walls so that the steering wheels are supported at four different points around their periphery. However, as desired, the shipping container may be square, rectangular, hexagonal or any other tubular shape which best suits the shape of the manufactured article being shipped in the container. Furthermore, the shelf members can be provided selectively on the walls, as desired, to furnish support in the desired locations as needed for the particular article being shipped.

In addition, although the drawings of the preferred embodiment show the panel to be a single sheet of corrugated plastic which is scored to provide the plurality of side panels, the container could also be made by attaching discretely formed panels together using hinges at the adjacent edges.

Thus, it is seen that the invention provides a new and improved returnable shipping container for manufactured articles such as steering wheels.

We claim:

1. A returnable shipping container for manufactured articles, comprising:

a plurality of rectangular wall panels serially arranged side by side and having a hinge acting between each adjacent panel with the end most of the panels having a free side thereof;

a separable fastener effective to establish the free sides of the endmost panels in adjacent relationship so that fastening the fastening means causes the container to be maintained in a tubular configuration defining an interior storage cavity and separating the fastener allows the container to be opened;

a plurality of slots provided in spaced apart relation along at least two of the wall panels; and a plurality of shelf member having a base wall adapted to lie against the slotted wall panels and having shelf arms which project through the slots and into the storage cavity to engage with and support the articles stored therein.

2. The container of claim 1 further characterized by the wall panel being a continuously formed strip of material having integral living hinges therein to define the plurality of wall panels.

3. The container of claim 1 further characterized by the separable fastener comprising a flexible strap having separable buckles elements carried by the ends thereof and the strap arranged to encircle the tubular configuration of the container.

4. The container of claim 1 further characterized by the shelf members having integral fasteners molded therein to retain the shelf member within the panel wall.

5. The container of claim 4 in which the flexible strap is captured between the wall panel and the base walls of the shelf members so that the flexible strap is retained in ready position with respect to the wall panels even when the separable fastener is separated and the container laid flat for storage.

* * * * *